US008839541B1

(12) United States Patent
Karfiol et al.

(10) Patent No.: US 8,839,541 B1
(45) Date of Patent: Sep. 23, 2014

(54) FIREARM HAVING CARTRIDGE FEED RAMP

(71) Applicants: Yury Karfiol, Brooklyn, NY (US); Leslie Edelman, Englewood, NJ (US); John Goliber, Leonia, NJ (US)

(72) Inventors: Yury Karfiol, Brooklyn, NY (US); Leslie Edelman, Englewood, NJ (US); John Goliber, Leonia, NJ (US)

(73) Assignee: Kimber IP, LLC, Yonkers, NY (US)

( * ) Notice: Subject to any disclaimer, the term of this patent is extended or adjusted under 35 U.S.C. 154(b) by 0 days.

(21) Appl. No.: 13/909,642

(22) Filed: Jun. 4, 2013

(51) Int. Cl.
*F41A 9/01* (2006.01)

(52) U.S. Cl.
CPC ..... *F41A 9/01* (2013.01)
USPC ..... 42/6

(58) Field of Classification Search
USPC ..... 42/77, 18, 17, 7, 6, 14; 89/29, 194, 162, 89/33.01, 33.1, 195, 197
See application file for complete search history.

(56) References Cited

U.S. PATENT DOCUMENTS 1,660,282 A * 2/1928 Prommer ..... 42/16
1,913,255 A * 6/1933 Von Frommer ..... 42/18
2,445,326 A * 7/1948 Janney ..... 89/1.11
2,585,738 A * 2/1952 Chapin et al. ..... 42/18
2,870,561 A * 1/1959 Colby ..... 42/18
3,177,603 A * 4/1965 Gillespie ..... 42/75.02
3,421,408 A * 1/1969 Badali et al. ..... 89/33.1
4,608,909 A * 9/1986 Peters ..... 89/196
4,907,362 A * 3/1990 Hobbie ..... 42/77
5,765,302 A * 6/1998 Brandl et al. ..... 42/18
5,983,773 A * 11/1999 Dionne ..... 89/29
6,276,252 B1 * 8/2001 Dionne ..... 89/29
6,604,314 B2 * 8/2003 Fluhr ..... 42/76.01
6,898,888 B2 * 5/2005 Greenhut ..... 42/18
8,234,807 B2 * 8/2012 LaTorre et al. ..... 42/28
8,291,806 B2 10/2012 Rael
8,356,539 B2 1/2013 Gonzalez

* cited by examiner

*Primary Examiner* — Reginald Tillman, Jr.
(74) *Attorney, Agent, or Firm* — Ceasar, Rivise, Bernstein, Cohen & Pokotilow, Ltd.

(57) ABSTRACT

A firearm having cartridges in a magazine is provided including a cartridge feed ramp disposed on the frame between the magazine chamber and the chamber end of the barrel. The cartridge feed ramp includes a base that is rigidly secured to the frame and a flexible tongue extending upwardly from the base, where the tongue acts as a spring and can deflect relative to the base. During a firing sequence, a top cartridge moves from the magazine in an upward direction toward the chamber end of the barrel, a front of the top cartridge contacts the flexible tongue of the cartridge feed ramp prior to entry by the cartridge into the chamber of the barrel, causing the flexible tongue to deflect outwardly in the direction of the front end of the barrel to assist the feeding of the top cartridge into the chamber end of the barrel.

4 Claims, 6 Drawing Sheets

FIREARM HAVING CARTRIDGE FEED RAMP

BACKGROUND OF THE INVENTION

The present invention is directed to hand firearms. More particularly, the present invention is directed to a system for improved feeding of cartridges for a firearm.

For some firearms, for example, semi-automatic pistols, it is very important to have a minimal number of actively movable elements of the firearm when a cartridge is picked-up from the firearm's magazine and is fed by the slide assembly of the firearm. The movement of the cartridge is complicated in that, as it moves into the barrel and as the spent casing is moved out of the barrel, the cartridge may tilt and partially rotate.

Known firearm designs, particularly pistol designs, use a stationary ramp feature that is located on the frame, on the barrel, or a combination of the frame and barrel. In some handguns, there may be functional problems because due to variations in cartridges used.

An example of a stationary ramp feature is shown in U.S. Pat. No. 8,234,807 (LaTorre et al.) which is directed to a high feed ramp for use in a Colt 1911 style handgun. The feed ramp is located on the frame of the gun and is for guiding cartridges into the barrel of the gun. The feed ramp is extended over the bottom edge of a chamfered barrel breach. During a firing cycle a new cartridge easily enters the barrel to prevent jamming or misfiring.

Another patent document directed to similar issues is U.S. Patent Publication No. 2012/0160083 (Rael) which is directed to a helical ammunition magazine. The magazine has an outer housing and a cylindrical inner wall surface. An inner support member is mounted within the housing and has a cylindrical outer wall surface. A helical ramp is disposed in a gap between the outer wall surface and the inner wall surface and is disposed within the gap and receives cartridges such that the longitudinal axis of the cartridges are oriented radially. The magazine includes a drive mechanism for advancing the cartridges along the helical ramp.

Finally, U.S. Pat. No. 8,356,539 (Gonzalez) is directed to an ammunition feed chute that has a plurality of feed chute links that are releasably connected together. The feed chute links have interior surfaces that define a guide path for belted ammunition.

All references cited herein are incorporated herein by reference in their entireties.

BRIEF SUMMARY OF THE INVENTION

The present invention is directed to a firearm having a frame, a barrel having a front end and a chamber end, and a magazine containing a plurality of cartridges. The firearm includes a cartridge feed ramp disposed on the frame between the magazine chamber of the frame and beneath the chamber end of the barrel. The cartridge feed ramp includes a base rigidly secured to the frame of the firearm and a flexible tongue extending upwardly from the base. The tongue acts as a spring, wherein the tongue deflects relative to the base. During a firing sequence of the firearm, a top cartridge of the cartridges in the magazine moves from the magazine in an upward direction toward the chamber end of the barrel, a front of the top cartridge contacts the flexible tongue of the cartridge feed ramp prior to entry by the cartridge into a chamber of the barrel, causing the flexible tongue to deflect outwardly in the direction of the front end of the barrel to assist the feeding of the top cartridge into the chamber end of the barrel.

The cartridge feed ramp may include an alignment channel disposed on the tongue to cause the cartridge to properly align with a longitudinal axis of the barrel as it moves from the magazine to the chamber end of the barrel, during a firing sequence.

More narrowly stated, the present invention is directed to a firearm having a frame, a slide, a barrel having a front end and a chamber end, and a magazine having a plurality of cartridges, the firearm comprising. A cartridge feed ramp is disposed on the frame between the magazine chamber of the frame and beneath the chamber end of the barrel. The cartridge feed ramp includes a base that is generally parallel to a longitudinal axis the barrel. The base is rigidly secured to the frame of the firearm. A flexible tongue extends upwardly from the base, where the tongue and base act together as a spring, wherein the tongue is adapted to deflect relative to the base. During a firing sequence of the firearm, a top cartridge of the plurality of cartridges moves from the magazine in an upward direction toward the chamber end of the barrel. A front of the top cartridge contacts the flexible tongue of the cartridge feed ramp prior to entry by the cartridge into a chamber of the barrel, causing the flexible tongue to deflect outwardly in the direction of the front end of the barrel to assist the feeding of the top cartridge into the chamber end of the barrel. The cartridge feed ramp may include an alignment channel disposed on the tongue to cause the cartridge to properly align with a longitudinal axis of the barrel as it moves from the magazine to the chamber end of the barrel, during a firing sequence.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
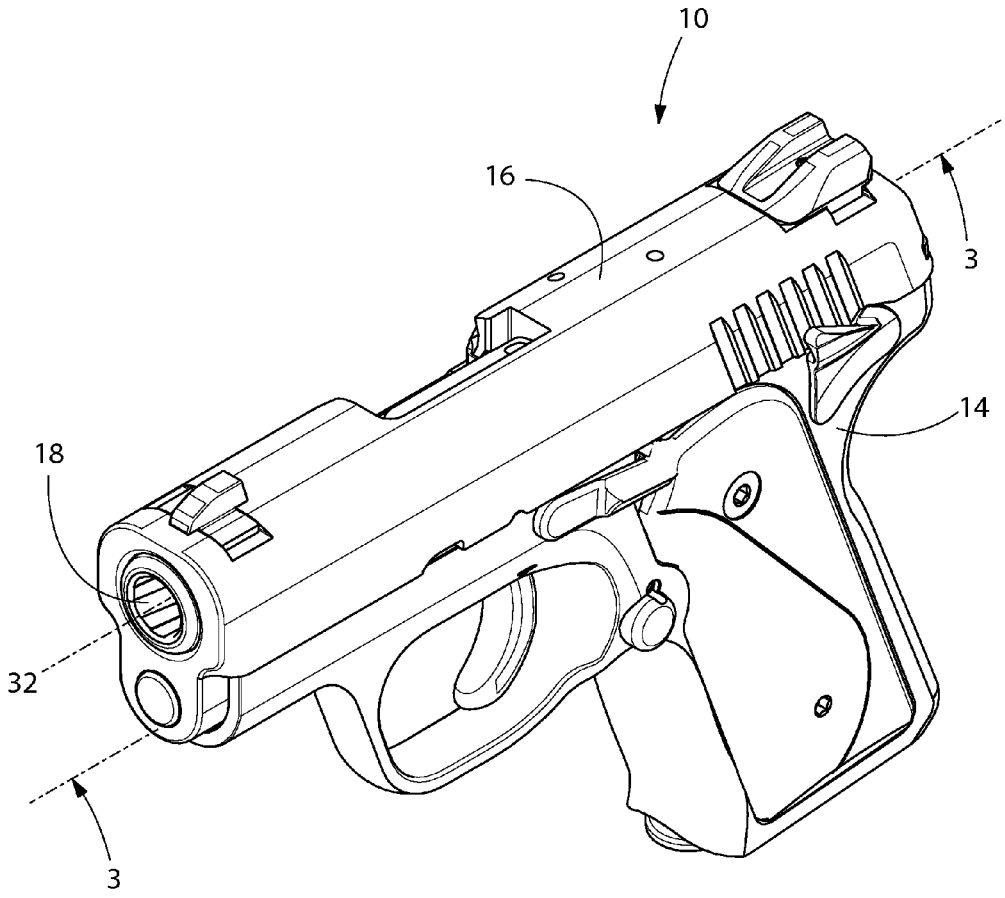
FIG. 1 is an isometric view of a firearm having a cartridge feed ramp in accordance with an exemplary embodiment of the present invention.
Figure 2:
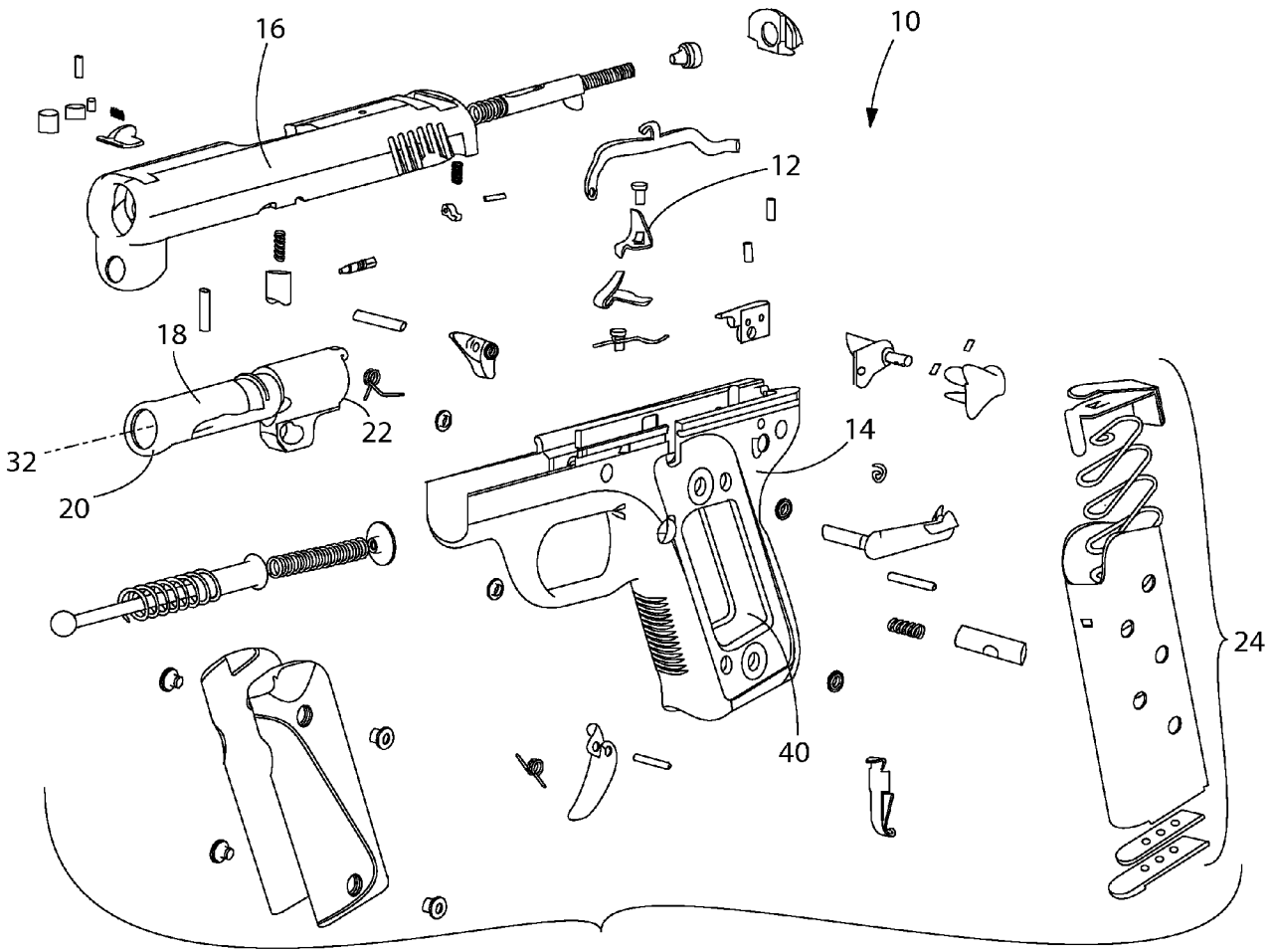
FIG. 2 is an exploded isometric view of the firearm having the cartridge feed ramp of FIG. 1.
Figure 3:
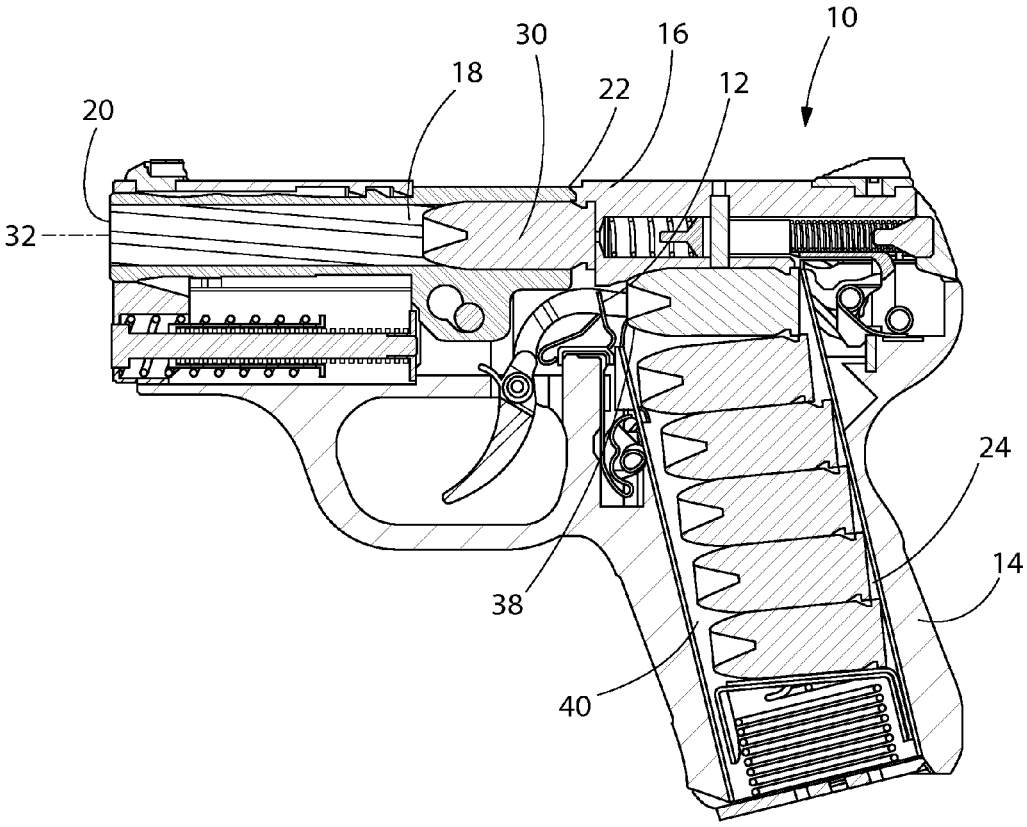
FIG. 3 is a cross sectional side view of the firearm having a cartridge feed ramp of FIG. 1, taken substantially along lines 3-3 of FIG. 1, shown with a cartridge in the barrel ready for a firing sequence.
Figure 4:
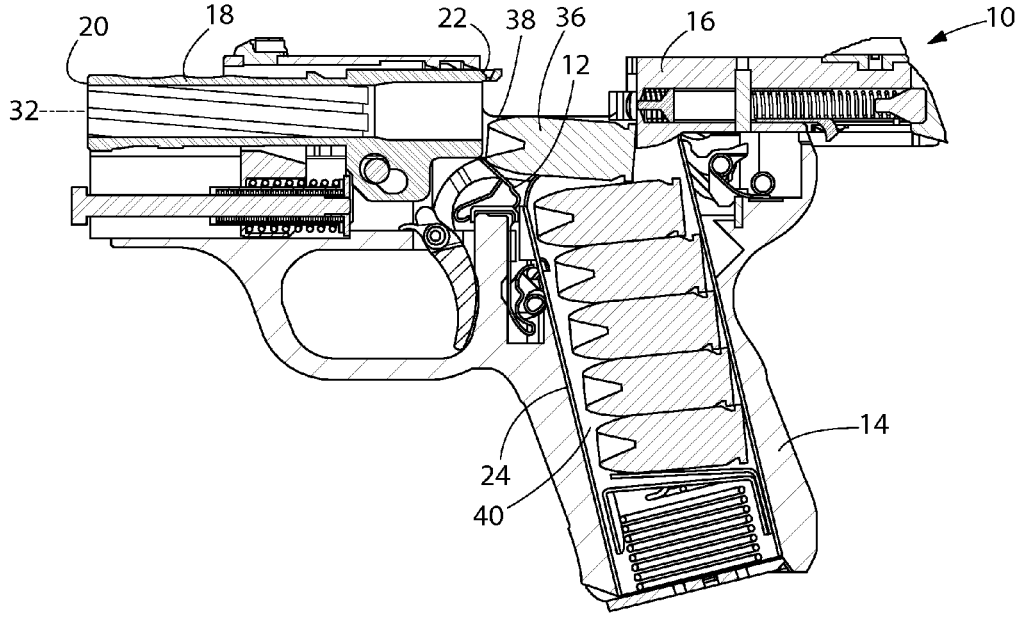
FIG. 4 is a cross sectional side view of the firearm having a cartridge feed ramp of FIG. 1, taken substantially along lines 3-3 of FIG. 1, but shown its slide retracted and with a cartridge prior to entry into its chamber, showing the feed ramp deflected, during a firing sequence.
Figure 5:
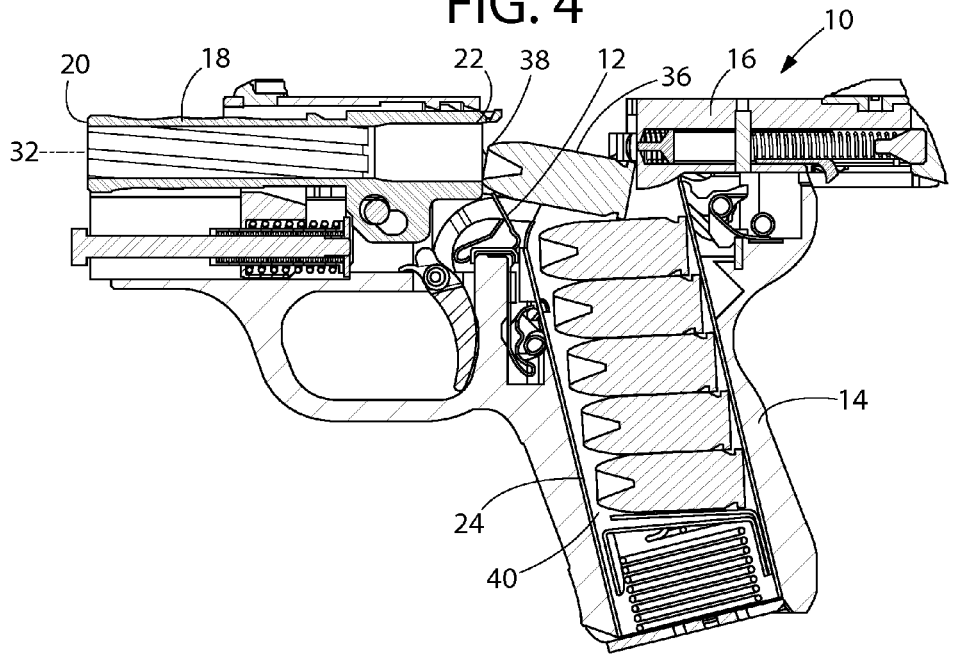
FIG. 5 is a cross sectional side view of the firearm having a cartridge feed ramp of FIG. 1, taken substantially along lines 3-3 of FIG. 1, but shown its slide retracted and with a cartridge prior to entry into its chamber, showing the feed ramp undeflected, during a firing sequence.

The invention will be illustrated in more detail with reference to the following embodiments, but it should be understood that the present invention is not deemed to be limited thereto.

Referring now to the drawing figures, wherein like part numbers refer to like elements throughout the several views, there is shown in FIGS. 1-5 a firearm 10 having a cartridge feed ramp 12 in accordance with an exemplary embodiment of the present invention. The exemplary is a semi-automatic firearm 10 and has a frame 14, a slide 16, a barrel 18 having a front end 20 and a chamber end 22, and a magazine 24. The magazine 24 is capable of delivering one cartridge 26 at a time to the chamber end 22 of the barrel 18 during a firing sequence.

Figure 6A:
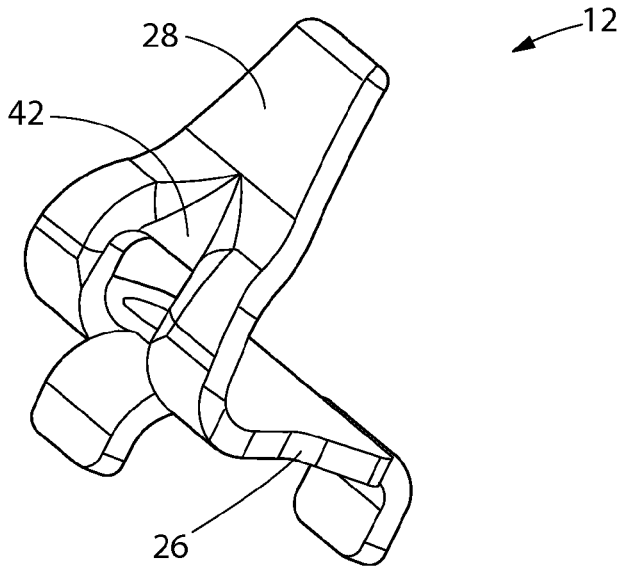
FIG. 6A is an isometric view of a cartridge feed ramp of the firearm of FIG.
Figure 6B:
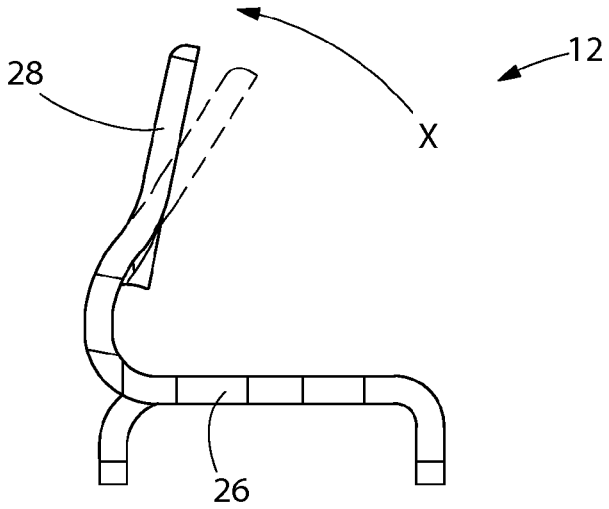
FIG. 6B is side view of the cartridge feed ramp of FIG. 6A, showing the cartridge feed ramp in an undeflected state, and showing the cartridge feed ramp in a deflected state in dashed lines.

As can best be seen in FIGS. 6A and 6B, the cartridge feed ramp 12 of the present invention has a base 26 and a flexible tongue 28 extending upwardly from the base 26. The flexible tongue 28 and base 26 act together as a spring, wherein the flexible tongue 28 is adapted to deflect outwardly in direction X (as shown in FIG. 6B) relative to the base 26 as a cartridge 30 moves from the magazine 24, contacts the cartridge feed ramp 12, and moves into to the chamber end 22 of the barrel 22 during a firing sequence. In one exemplary embodiment, as shown, the base 26 is generally parallel to a longitudinal axis 32 of the barrel 18, but other configurations are within the intended scope of this invention. The base 26 is rigidly secured to the frame 14 of the firearm 10.

Figure 7:
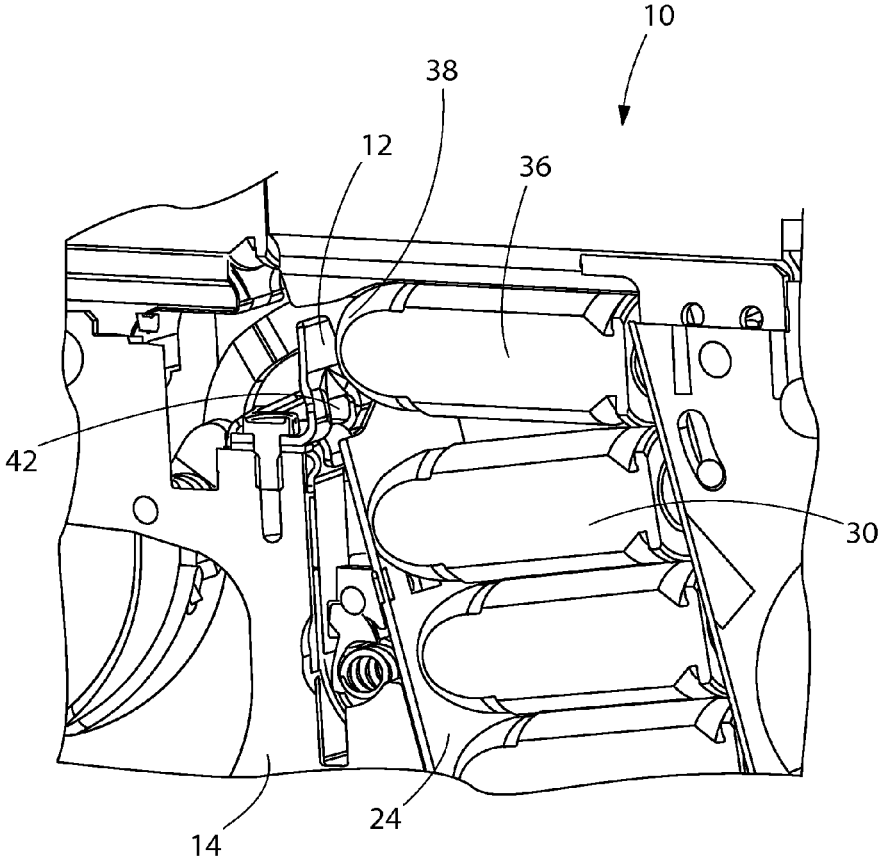
FIG. 7 is a simplified cross-sectional view of a portion of the firearm of FIG. 1, wherein a cartridge is contacting the cartridge feed ramp prior to moving into position in the chamber of the firearm.

The base 26 of the cartridge feed ramp 12 is rigidly disposed on the frame 14 between the magazine chamber 40 of the frame 12 and the chamber end 22 of the barrel 18. Specifically, for a typical semi-automatic pistol that has a slide that moves relative to the frame of the firearm, as is well known to those skilled in the art, during a firing sequence (where, after the pistol is fired, the slide retracts in a rearward direction, a spent casing is discharged, and a new cartridge is moved into firing position in the chamber end of the barrel), a top cartridge 36 of the cartridges in the magazine 24 moves from the magazine in an upward direction toward the chamber end 22 of the barrel 18. The front 38 of the top cartridge 36 contacts the flexible tongue 28 of the cartridge feed ramp prior 12 to entry by the top cartridge 36 into a chamber of the barrel 22, causing the flexible tongue 28 to deflect outwardly in the direction of the front 20 end of the barrel 18 to assist the feeding of the top cartridge 36 into the chamber end 22 of the barrel 18. See FIGS. 4 and 7.

As best shown in FIG. 6A, the cartridge feed ramp 12 may include an alignment channel 42 disposed on the flexible tongue 28 to cause the top cartridge 36 to properly align with the longitudinal axis 32 (see FIGS. 1-5) of the barrel 18 as it moves from the magazine 24 to the chamber end 22 of the barrel 18, during a firing sequence.

While the invention has been described in detail and with reference to specific examples thereof, it will be apparent to one skilled in the art that various changes and modifications can be made therein without departing from the spirit and scope thereof.

What is claimed is:

1. A firearm having a frame, a barrel having a front end and a chamber end, and a magazine having a plurality of cartridges, the firearm comprising:

(a) a cartridge feed ramp disposed on the frame between a magazine chamber of the frame and beneath the chamber end of the barrel, said cartridge feed ramp fabricated from bent sheet metal, comprising:

(i) a base having a unitary flexible tongue, the base rigidly secured to the frame of the firearm; and (ii) the flexible tongue extending upwardly from the base, the tongue acting as a spring, wherein the tongue deflects relative to the base (b) wherein, during a firing sequence of the firearm, a top cartridge of the plurality of cartridges moves from the magazine in an upward direction toward the chamber end of the barrel, a front of the top cartridge contacts the flexible tongue of the cartridge feed ramp prior to entry by the cartridge into a chamber of the barrel, causing the flexible tongue to deflect outwardly in the direction of the front end of the barrel to assist the feeding of the top cartridge into the chamber end of the barrel.

2. The firearm of claim 1, wherein the cartridge feed ramp includes an alignment channel disposed on the tongue, to cause the cartridge to properly align with a longitudinal axis of the barrel as it moves from the magazine to the chamber end of the barrel, during a firing sequence.

3. A firearm having a frame, a slide, a barrel having a front end and a chamber end, and a magazine having a plurality of cartridges, the firearm comprising:

(a) a cartridge feed ramp disposed on the frame between a magazine chamber of the frame and beneath the chamber end of the barrel, said cartridge feed ramp fabricated from bent sheet metal, comprising:

(i) a base having a unitary flexible tongue, said base being generally parallel to a longitudinal axis the barrel, the base rigidly secured to the frame of the firearm; and (ii) the flexible tongue extending upwardly from the base, the tongue and base acting together as a spring, wherein the tongue deflects relative to the base; and (b) wherein, during a firing sequence of the firearm, a top cartridge of the plurality of cartridges moves from the magazine in an upward direction toward the chamber end of the barrel, a front of the top cartridge contacts the flexible tongue of the cartridge feed ramp prior to entry by the cartridge into a chamber of the barrel, causing the flexible tongue to deflect outwardly in the direction of the front end of the barrel to assist the feeding of the top cartridge into the chamber end of the barrel.

4. The firearm of claim 3, wherein the cartridge feed ramp includes an alignment channel disposed on the tongue, to cause the cartridge to properly align with a longitudinal axis of the barrel as it moves from the magazine to the chamber end of the barrel, during a firing sequence.

* * * * *